United States Patent [19]

Nerli et al.

[11] Patent Number: 4,704,859

[45] Date of Patent: Nov. 10, 1987

[54] ROTARY TWISTER ELEMENT FOR FRICTIONAL OPEN-END SPINNING

[75] Inventors: Giovanni Nerli, Florence; Francesco Grego, Venice; Roberto Bottos; Francesco Ferro, both of Pordenone, all of Italy

[73] Assignee: Officine Savio S.p.A., Pordenone, Italy

[21] Appl. No.: 10,407

[22] Filed: Feb. 3, 1987

[30] Foreign Application Priority Data

Feb. 26, 1986 [IT] Italy ..... 19551 A/86

[51] Int. Cl.[4] ..... D01H 7/892; D01H 7/898

[52] U.S. Cl. ..... 57/401

[58] Field of Search ..... 57/400, 401, 411

[56] References Cited

U.S. PATENT DOCUMENTS 4,168,601 9/1979 Didek et al. ..... 57/401
4,222,222 9/1980 Didek et al. ..... 57/401
4,537,312 3/1986 Brockmanns et al. ..... 57/401
4,660,366 4/1987 Barrett et al. ..... 57/401 X
4,660,371 4/1987 Stalder ..... 57/401

*Primary Examiner*—Donald Watkins

*Attorney, Agent, or Firm*—Hedman, Gibson Costigan & Hoare

[57] ABSTRACT

Rotary twister element suitable to keep under tension the fibres during the twisting operation in a frictional open-end spinning process, constituted by a solid, hollow, reduced-thickness element with perforated skirt, which is internally provided with a suction duct defining a longitudinal slot, the edge of which constitutes the thread formation line, is suitably inclined relatively to the general trix of the same solid, hollow element, as a function of the direction of rotation of the solid element, and of the direction of thread extraction. Also a screen is provided for the air dragged by the rotation of the solid element, which may have a cylindrical shape, a cone frustum shape, or the shape of any other revolution solid.

3 Claims, 4 Drawing Figures

ROTARY TWISTER ELEMENT FOR FRICTIONAL OPEN-END SPINNING

The present invention relates to a rotary twister element which, by keeping under a proper adjustable tension the fibres during the twisting, and hence drafting and straightening them, allows a thread having high characteristics of quality and strength to be obtained.

More specifically, the invention relates to a rotary twister element to be applied in a spinning process of frictional open-end type, which provides for the fibres to be kept under an adjustable tension during their twisting, such as that as disclosed in our prior U.S. patent application Ser. No. 896,281 filed on Aug. 14, 1986.

According to said process, the fibres of the feed web are opened and separated from one another by a suitable separating and parallelling unit, and are then sent to deposit on a rotary and perforated twisting device, to the purpose of feeding the open end of the thread being formed, which is sucked and kept adherent to said perforated twisting device by a sucking slot, along the edge of which, constitutes the thread formation line, said open end is twisted, due to the effect of the forces generated by the suction and the rotation; said open end must be then fed with fibres according to a direction parallel to said edge of the suction slot and in the opposite direction relatively to the direction of extraction of the thread being formed, and, above all, said fibres have to be kept under tension throughout the twisting operation.

Now then, the rotary twisting element which keeps drafted the fibres coming from the feed web while they are being twisted, is characterized according to the present invention in that it is constituted by a solid, hollow, reduced-thickness element with perforated skirt, which is internally provided with a suction duct which defines a longitudinal suction slot, the longitudinal edge of which constitutes the thread formation line, is inclined relatively to the generatrix of the same solid element.

In such a way, in fact, the speed of fibre dragging in the individual points of the slot, deriving from the rotation of the solid element, to which the fibres are kept adherent by the suction, has a twisting component having a direction perpendicular to the slot, and an axial component in the direction of the slot, or, better, of the slot edge, which constitutes the thread formation line, which, by a suitable choice of the direction of rotation of the solid element, and of the thread extraction direction, can be directed in the opposite direction relatively to the thread extraction direction, that means that the fibres of the thread being formed are kept under tension.

It derives hence from the above that, according to another characteristic of the present invention, the said longitudinal slot edge, which constitutes the thread formation line, has an inclination, relatively to the generatrix of the same solid element, which is a function of the direction of rotation of the solid element and of the direction of extraction of the thread, so to submit each fibre to an axial component in the direction of said edge, which is directed in the opposite direction relatively to the thread extraction direction.

It should be observed then that the present invention allows the said thread tensioning to be easily and rapidly adjusted, as desired, by simply varying the inclination degree of said longitudinal slot edge, and therefore, definitely, by varying the inclination of the open end of the said suction duct: a greater inclination shall cause, evidently, a higher tensioning.

Finally, according to a preferred form of practical embodiment of the present invention, said rotary solid, hollow element cooperates with a shield positioned close to or in contact with it, upstream the longitudinal suction slot relatively to the rotation of the same solid element, which is provided to the purpose of preventing the air dragged by the solid element during its rotation from having the possibility of disturbing the open end of the thread being formed.

The invention is now clarified in greater detail by referring to the hereto attached drawings, which illustrate a preferred form of practical embodiment, given to purely exemplifying and not limitative purposes, in that in any case, technical and structural variants may be supplied within the scope of the invention. So, for example, the solid, hollow element may have, instead of a hollow cylindrical shape, a cone-frustum shape, or the shape of any other revolution solid.

Figure 1:
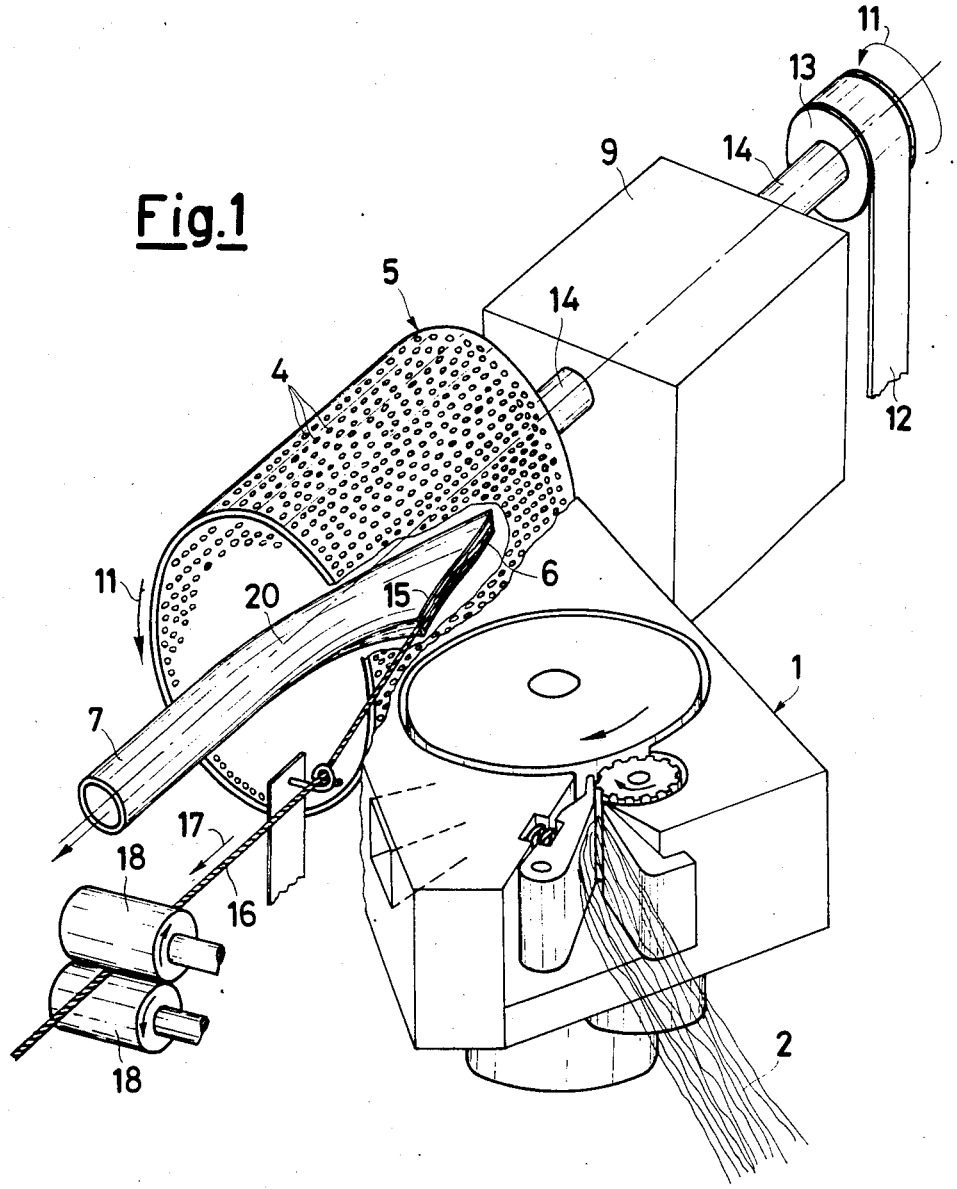
FIG. 1 shows, in a perspective scrap view, a device for the frictional open-end spinning, using a rotary twisting element according to a form of the invention.

Referring to the Figures, with 1 the feed unit is generally shown, per se well known in the art of open-end spinning, which has the task of separating from and parallelling to one another the fibres of the fibre web 2 being fed and to deliver them, through the channel 3 (see specifically FIG. 2), onto the perforated skirt 4 of the rotary solid twister element constituted by a hollow, reduced-thickness cylinder 5, in correspondence of the longitudinal area or slot 6 (see specifically FIG. 3), undergoing a suction applied by the suction duct 7, connected to a suction source not shown in figure, which duct enters inside the perforated cylinder 5 and is kept fastened by the support 8.

Said perforated cylinder 5 is rotatably supported, cantilevered, by a structure 9, through bearings 10 (see specifically FIG. 2) and is driven in rotary motion according to the direction of arrow 11 by the transmission belt 12 engaged on pulley 13 integral with its shaft 14.

Figure 2:
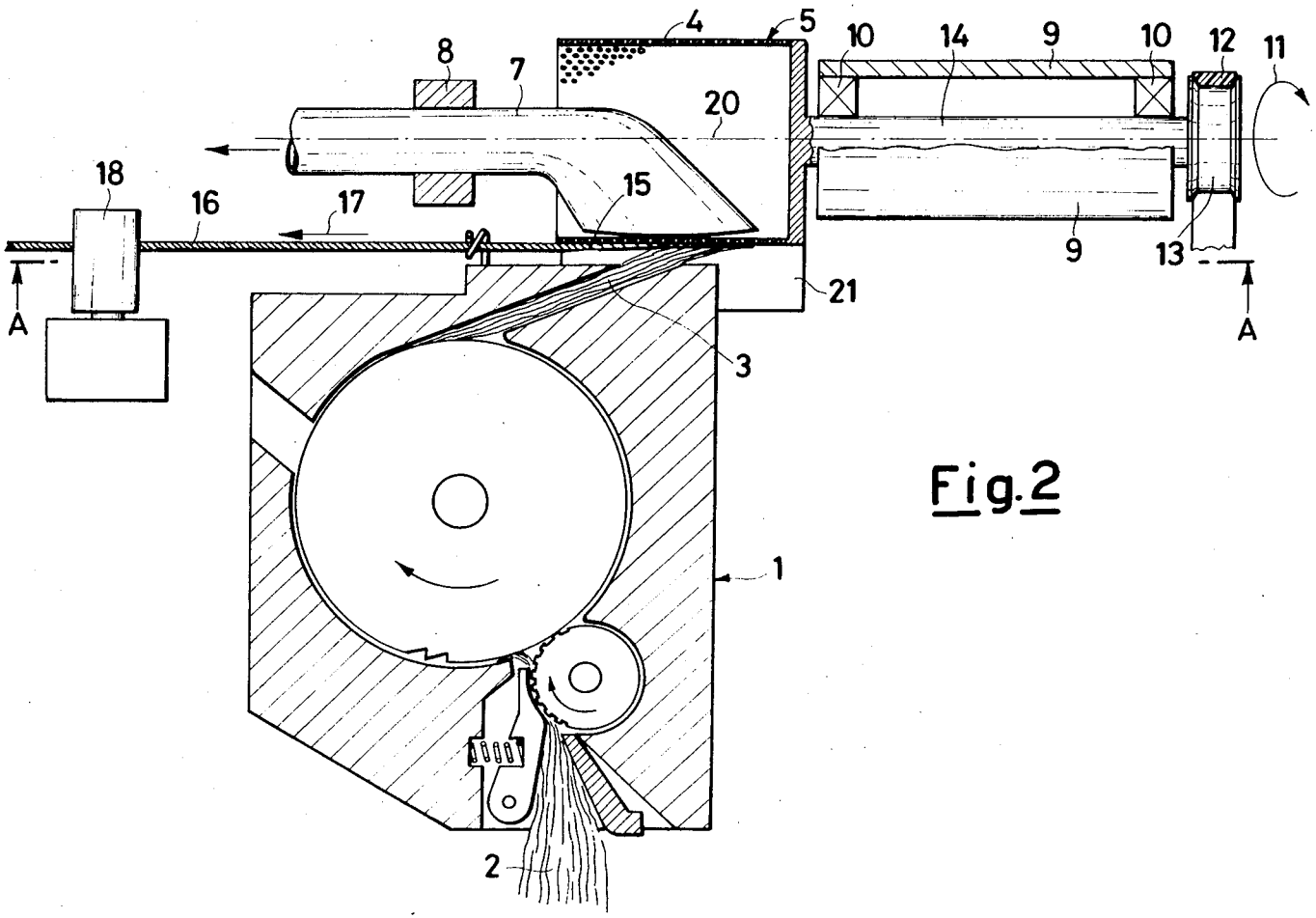
FIG. 2 shows a sectional plan view of the device of FIG. 1.

The feed of fibres to the open end 15 of the thread being formed 16, which is extracted in the direction of arrow 17 by means of the collection rollers 18, is performed, through the duct 3, in a direction parallel to the longitudinal edge 19 of the slot 6, constituting the thread formation line, and in the opposite direction relatively to the thread extraction direction 17, as it can be clearly seen in FIG. 2.

On the other side, the suction slot 6 and consequently its longitudinal edge 19 is positioned, according to the present invention, inclined relatively to the generatrix of the cylinder or, which is the same, relatively to the cylinder axis 20.

Figure 3:
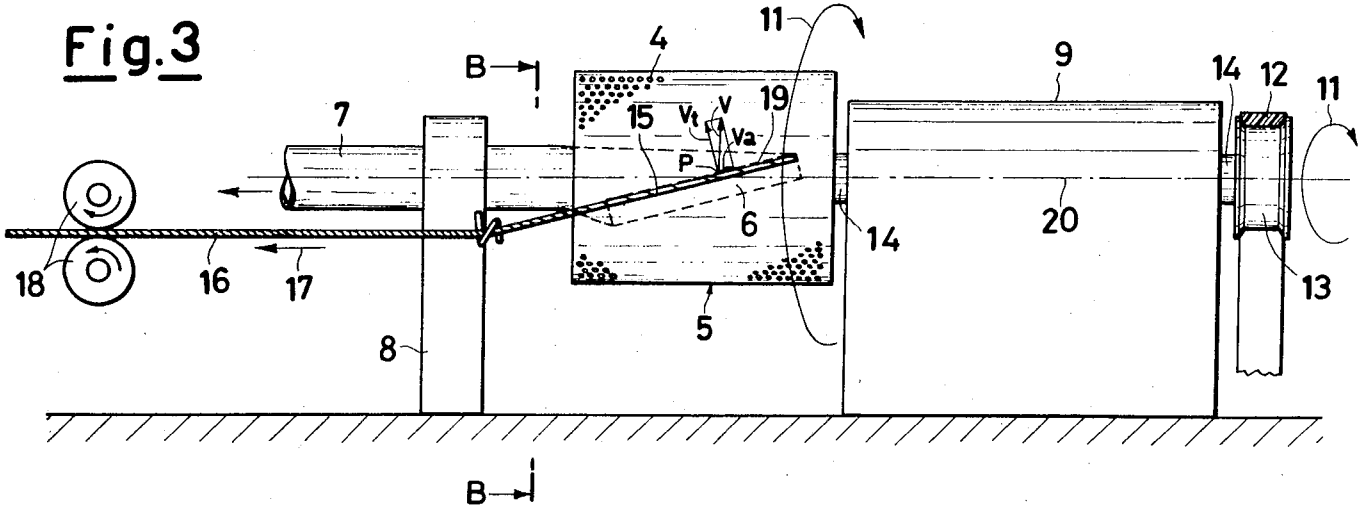
FIG. 3 shows a longitudinal view taken along A—A path of FIG. 2.

By considering the direction 11 of cylinder rotation and the direction 17 of thread extraction, the slot 6 and, in particular, said longitudinal edge 19, which constitutes the thread formation line, must be inclined as shown in FIG. 3, so that the speed of fibre dragging in the individual points, e.g., in a point P (see FIG. 3), of the line 19 of thread open end formation, is resolved in an twisting component $v_t$ and in an axial component $v_a$ directed in the opposite direction relatively to the direction 17 of thread extraction.

Figure 4:
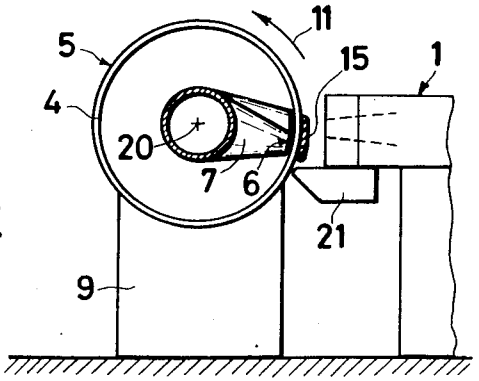
FIG. 4 shows a front scrap view taken along B—B path of FIG. 3.

Finally, a screen 21 is positioned close to or in contact with the cylinder 5 (see FIG. 4) and upstream the slot 6 relatively to the direction 11 of rotation of the same cylinder, to stop the air dragged by the rotation of the cylinder and prevent it from having the possibility of disturbing the open end 15 of the thread being formed.

We claim:

1. Rotary twister element for frictional open-end twisting, constituted by a solid, hollow, reduced-thickness element with perforated skirt, provided in its interior with a suction duct defining a longitudinal suction slot, one of the two longitudinal edges of which constitutes the thread formation line, characterized in that said edge constituting the thread formation line is inclined relatively to the generatrix of the same solid element.

2. Rotary twister element according to claim 1, characterized in that the said inclination relatively to the generatrix of the rotary solid element of said longitudinal edge of the slot which constitutes the thread formation line, is a function of the rotation direction of the solid element, and of the direction of thread extraction, so to submit each fibre to an axial component in the direction of the said edge, which is directed in the opposite direction relatively to the direction of thread extraction.

3. Rotary twisting element according to claim 1, characterized in that it comprises a shield positioned close to or in contact with said solid, hollow element, upstream said longitudinal suction slot relatively to the rotation of the said solid element.

* * * * *